United States Patent [19]

Richardson

[11] 4,193,332

[45] Mar. 18, 1980

[54] MUSIC SYNTHESIZING CIRCUIT

[76] Inventor: Charles B. Richardson, 1104 N. 17th St., Nederland, Tex. 77627

[21] Appl. No.: 943,058

[22] Filed: Sep. 18, 1978

[51] Int. Cl.[2] ..... G10H 3/00

[52] U.S. Cl. ..... 84/1.01; 84/1.19; 84/1.24; 84/1.26

[58] Field of Search ..... 84/1.01, 1.11, DIG. 10, 84/1.19, DIG. 18, 1.26, 1.03, 1.24; 364/727; 331/1 A, 18, 25; 178/68; 179/15 BC; 340/347 DD

[56] References Cited

U.S. PATENT DOCUMENTS

| | | | |
|---|---|---|---|
| 3,878,749 | 4/1975 | Woron | 84/1.01 |
| 3,881,389 | 5/1975 | Allen | 84/454 |

OTHER PUBLICATIONS

J. Cox, "Frequency Synthesizer," Ham Radio Magazine, Sep. 1973, pp. 30–38

*Primary Examiner*—B. Dobeck
*Assistant Examiner*—Forester W. Isen
*Attorney, Agent, or Firm*—Donald Gunn

[57] ABSTRACT

A music synthesizer is disclosed. In the preferred embodiment, it cooperates with a tone source, such as a conventional or traditional music instrument, to form a synthesized output. The output can be voiced to provide music shaped and modified to a desired form. The circuit of the present invention uses an input signal supplied to a phase lock loop circuit coupled to a Walsh function generator providing Walsh output signals at frequencies corresponding to the input fundamental tone and a cascade of harmonics of the fundamental. The signals are selectively summed and weighted to form an output.

21 Claims, 6 Drawing Figures

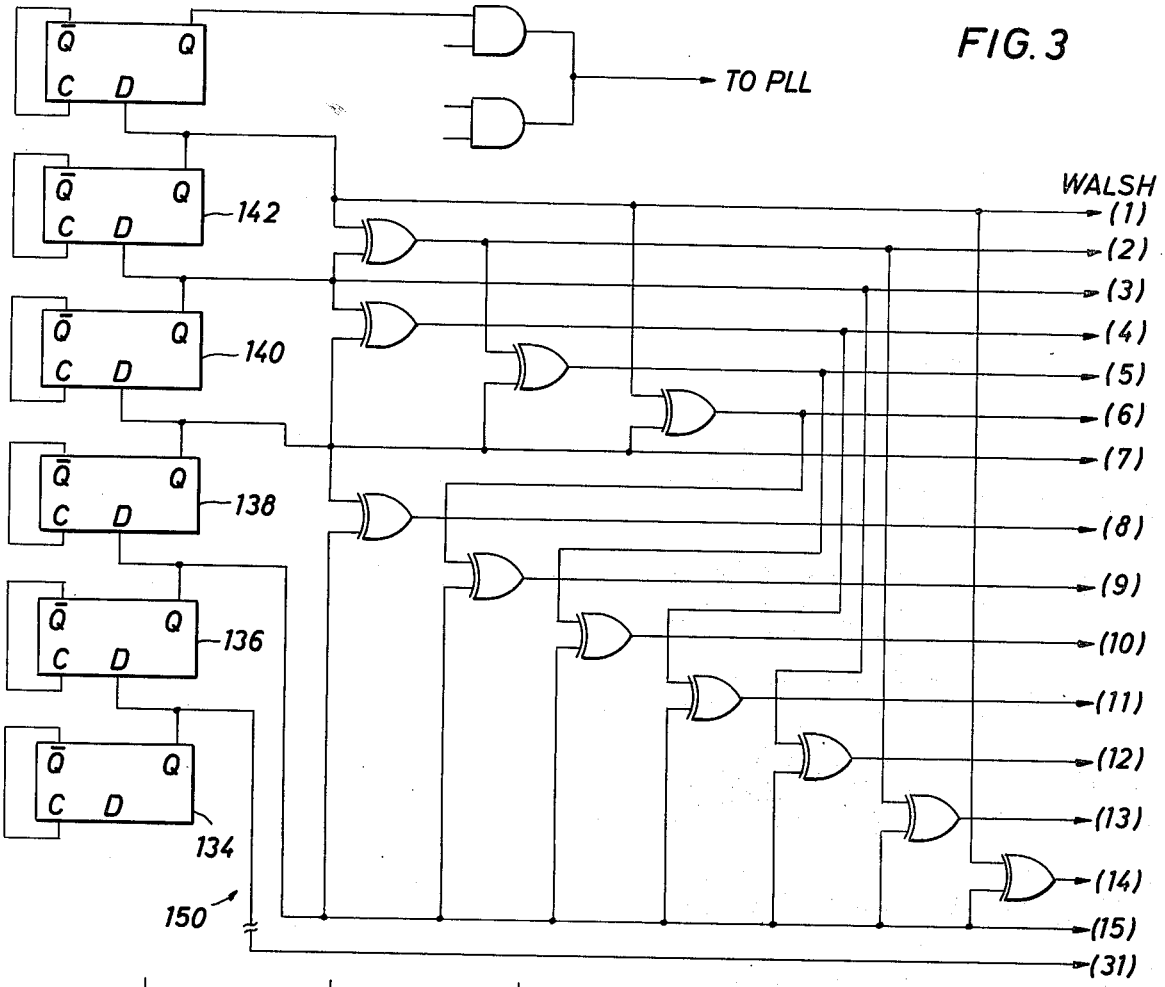
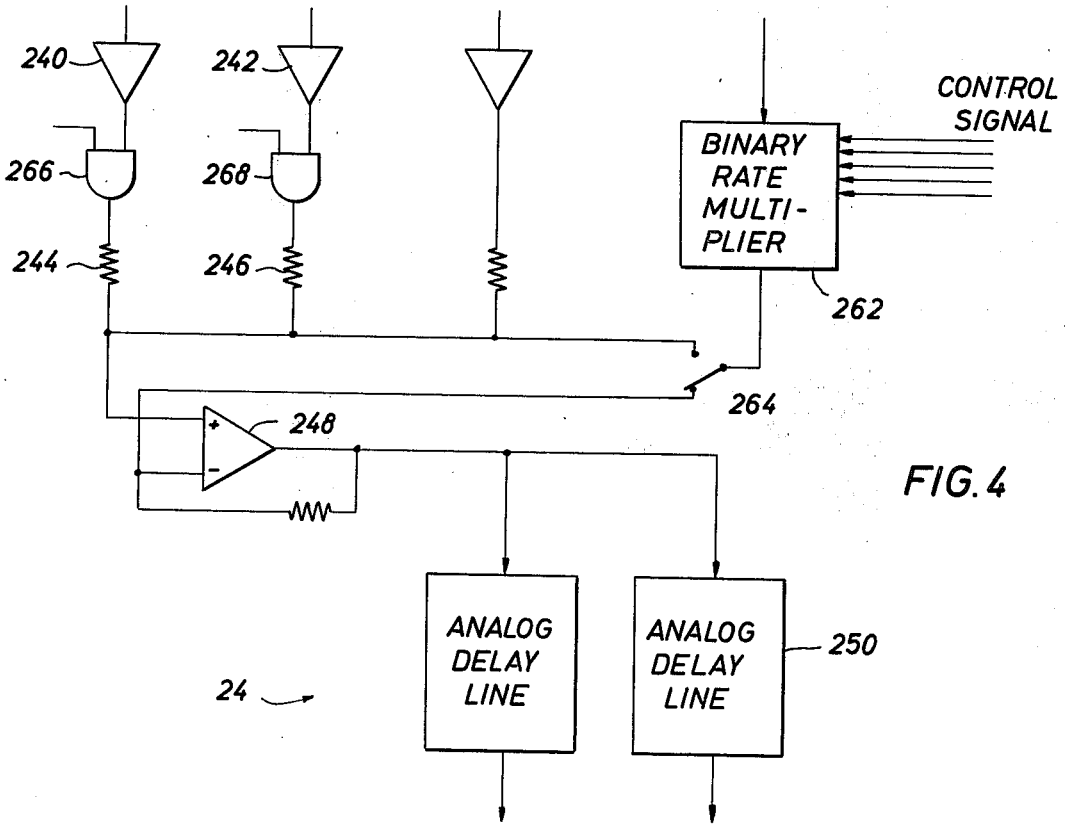
FIG. 4

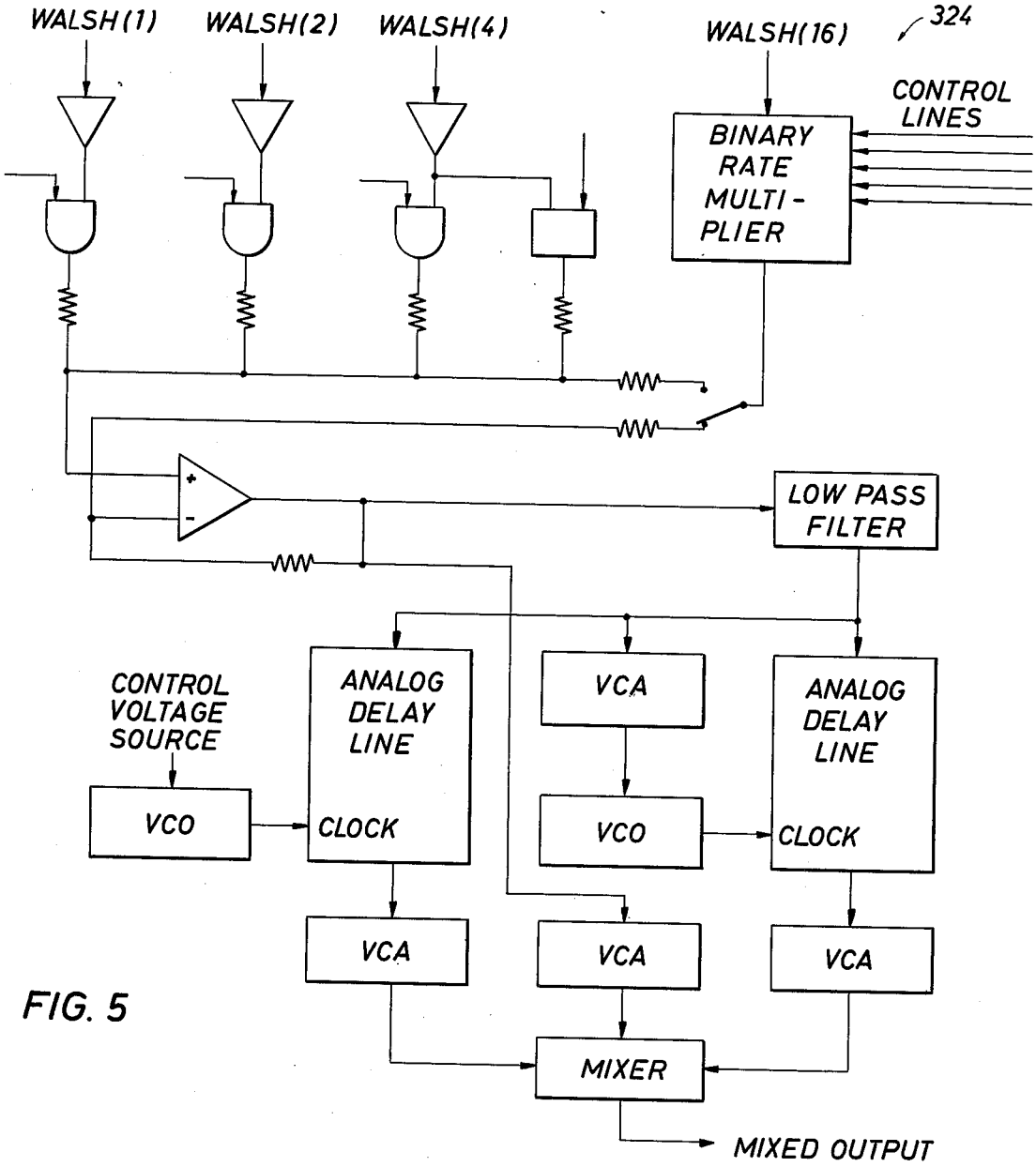
FIG. 5
FIG. 6
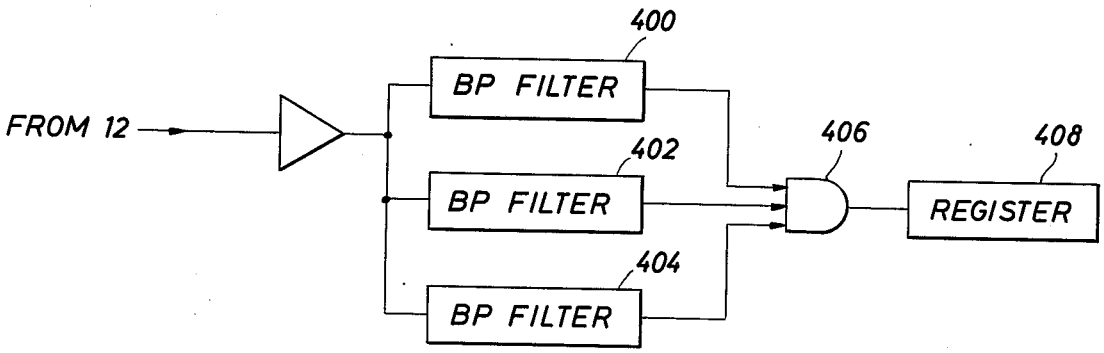

MUSIC SYNTHESIZING CIRCUIT

BACKGROUND OF THE DISCLOSURE

There are several basic approaches for utilization in music synthesizers. One basic approach is to utilize a musical instrument as a source to derive a tone from the instrument and thereafter process the signal representing the tone to strip the tone of various harmonics to derive a fundamental which is modulated by the musician, all for the purpose of reconstructing various and sundry harmonics through the use of analog circuitry. Such a system is primarily analog in nature. Imagine such a system used with a string instrument, woodwind, reed or brass source. It may form an output signal with ample coloring distinctive of the particular instrument; nevertheless, the coloring is stripped away, and only a fundamental tone is left. The fundamental may range high or low depending on the range achieved by the instrument in question. The musical instrument's distinctive quality remains in that the fundamental is shaped or modified as, for instance, by changes in frequency or pitch, change in fundamental amplitude at the moment of attack, decay of the note and so on. The fundamental is then passed through various and sundry harmonic generators. The harmonic generator can typically form various harmonics, and they are then passed through an adding circuit, the net result being a composite waveform which has been voiced to a specified mix. Certain arbitrary decisions can be made, such as the decision to repress even numbered harmonics. This lends a certain kind of voicing or timbre to the output signal.

Other types of synthesizers are known, including those which utilize an oscillator as a tone source as opposed to a musical instrument. Electronic keyboard insruments typify this approach. This approach, however, is deficient in several regards. Among others, it can never quite accomplish a totally realistic duplication of a given natural instrument's timbre as a stand-alone unit, perhaps being satisfied with only a surrealistic effect. It is simpler in some regards than the analog circuitry of the above mentioned synthesizer. It is fairly difficult to overcome the surrealistic effect when the goal is to precisely duplicate a given instrument (representative). Moreover, such apparatus is still faced with certain arbitrary limits or tradeoffs. As an example, imagine an oscillator signal source functioning as the basic tone generator from which electronic synthesis is accomplished. The signal output, and, hence, the timbre, attack, vibrato, pianissimo, tremolo and the like, must be imposed on the oscillator source. Fortunately, these things are easily imposed on musical instruments by the musician, himself, through the talents developed in his playing ability.

The present invention is markedly different. The present invention is an electronic music synthesis system which is substantially digital in operation. In other words, it utilizes digital circuitry components to handle a monotonic source (for ease of explanation) to produce a digital synthesizer which operates in real time with any kind of input source, including conventional musical instruments. The input frequency source thus preserves the qualities that characterize music as such, including player initiated vibrato, tremolo, pianissimo and the like. A simple transducer serves as an input source and supplies a monotonic note signal. The apparatus thus rolls off some of the harmonics through filters which suppress the higher frequencies to provide a reasonably well defined fundamental frequency and controlled amplitude. The fundamental frequency will carry with it all of the necessary constituent musical qualities which identify real or naturally occurring music in the conventional sense. In other words, the mode of attack and the ending of a given note are preserved. Vibrato and tremolo of the note are preserved. Note intensity or loudness is preserved. Transition from a first note to a second note is also preserved. A synthesized output is achieved with negligible time delay so that the device can truly be described as operating in real time. Real time is substantially no time lag as determined by the ear of a musician.

The present invention has certain advantages over the prior art devices. One advantage is that the qualities of the natural instrument are preserved as mentioned above. If an excess of data information is stripped away from the input signal, the qualities distinctive of the source are lost. This approach is clearly better than the use of an oscillator as a tone source. Moreover, the use of digital circuitry provides a less expensive circuit. Further, digital circutiry has the virtue of functioning well or not functioning at all in contrast with analog circuitry which degrades slightly and gradually over a period of time. Through the use of the digital circuitry herein disclosed, the circuit is able to preserve the primary waveform generator characteristics to either duplicate or modify the distinctive timbre of a specified instrument. Accordingly, it can be used in the sense of providing duplication or voicing to another quality. Duplication can occur as in the example of a musician playing a six-string guitar, where the output would resemble that of a twelve-string guitar. Alternately, a chorus effect can be achieved whereby a single musician is, in effect, provided with a second chair musician, even though one is not physically present. Another mode of expression can be achieved whereby a soloist receives an accompaniment from an instrument of an entirely different family, as, for instance, accompaniment of a brass instrument by a reed instrument, if the device were so voiced. Fortunately, the rules which describe the audio distinctives of brass instruments versus woodwinds are well known. The distinctives of other musical instruments are also reasonably well known, speaking in global terms, and these distinctives can be implemented by this apparatus.

It is with the foregoing in mind that the present invention has been devised. It particularly lends itself to the kind of voicing mentioned above.

BRIEF DESCRIPTION OF THE DRAWINGS

FIG. 3 is a detailed schematic of the Walsh function generator matrix;

FIG. 4 is a simplified ensemble processor;

FIG. 5 is a more complex ensemble processor; and

FIG. 6 is a pattern recognition circuit.

DETAILED DESCRIPTION OF THE ILLUSTRATED EMBODIMENT

Figure 1:
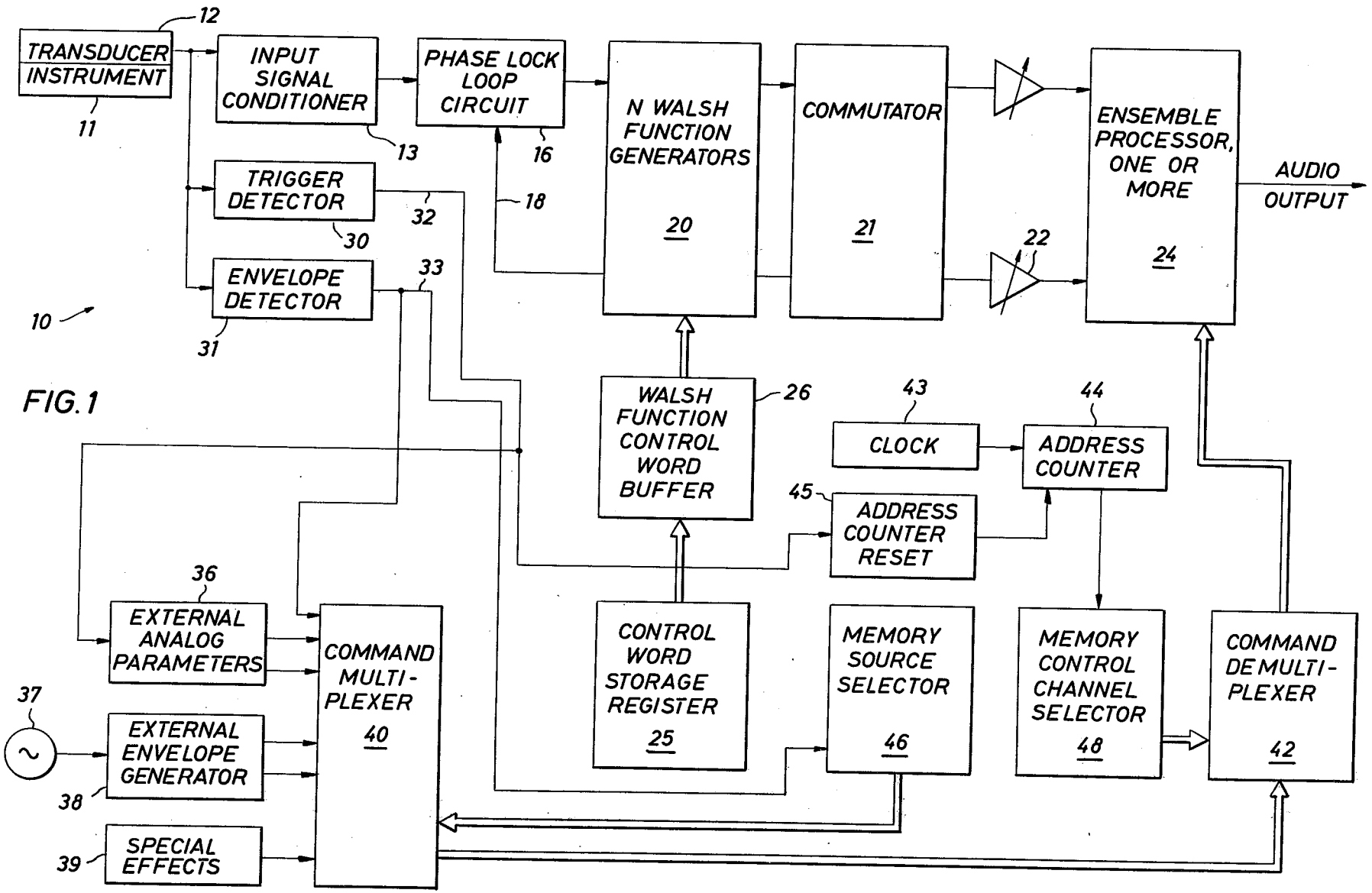
FIG.1 is an overall schematic block diagram of the present invention.

Attention is first directed to FIG. 1 of the drawings where the numeral 10 identifies the music synthesizer of the present invention in detail. Beginning with the input of the device, it is appropriate to begin at the musical instrument 11 which serves as a tone source. It is a monotonic tone source, i.e., a single tone source. This is quite readily and easily accomplished in wind instruments, including brass and reeds. This is also appropriate in string instruments so long as only a single string is plucked or bowed. In the playing of a violin, viola, etc., it is possible to play double stops, i.e., to bow two strings simultaneously. In that instance, it is necessary to incorporate two or more voicing systems with the musical instrument 11. The instrument can have any size, shape and construction, and it is typically a musical instrument which provides monotonic output. A transducer 12 is connected to it in some suitable fashion and serves as a pickup which picks off a tone. If the instrument 11 is a horn, the pickup 12 is a source of signals for the full range of the instrument. If the instrument 11 is a string instrument, such as a violin, guitar, etc., then a separate transducer, such as a microphone, is utilized for each string. Alternately, one microphone can be used for all strings provided that the device is played one note at a time.

The fundamental and multiple harmonics are input to an input signal conditioner 13 having a low pass filter. Sharp filter definition is not necessary. The filter suppresses the higher number harmonics relative to the fundamental. A roll off of three to twelve decibels compared with the harmonic input level is typically adequate. The signal is amplified to a suitable level. The fundamental and the various harmonics which remain are then input to a signal clipper which, utilizing an overdriven input, clips the peaks to form substantially a squarewave. One alternate mode of squaring off the signal is to input it to a Schmitt trigger circuit. The squarewave output of the initial signal conditioner 13 is then applied to a phase lock loop circuit mixer 16. This apparatus incorporates an integrated circuit, and one typical device which will serve quite well is the CD4046, manufactured by MCI. This voltage controlled oscillator compares the loop input from the conditioner with a second or feedback signal on the conductor 18.

A feedback loop is defined utilizing the phase lock loop circuit 16 and a cascade of Walsh function generators indicated generally at 20. This chain includes N Walsh function generators sequentially connected. It forms a feedback output for the phase lock loop circuit 16. The multitude of generators at 20 form digital signal outputs. They are supplied to a commutator 21 which, in turn, supplies selected outputs to buffer or isolation amplifiers 22. The amplifiers are all similar. One suitable device is an emitter follower. As an example, there might be thirty-two Walsh function generators input to the commutator 21. There can just as readily be thirty-two outputs from the commutator. The thirty-two outputs are then supplied through individual amplifiers 22, there being the same number as the N Walsh function generators previously identified. Simplistically, the various Walsh signals are summed by simple or complex summing means to be described, and the summed signals are then output to an amplifier, a speaker or tape recorder. More will be noted regarding the summing means.

The operation of the Walsh function generator is modified by supplying a control word from a control word storage register 25. It is input to a Walsh function control word buffer 26 which delivers the control word to the Walsh function generators as shown in FIG. 1.

Figure 2:
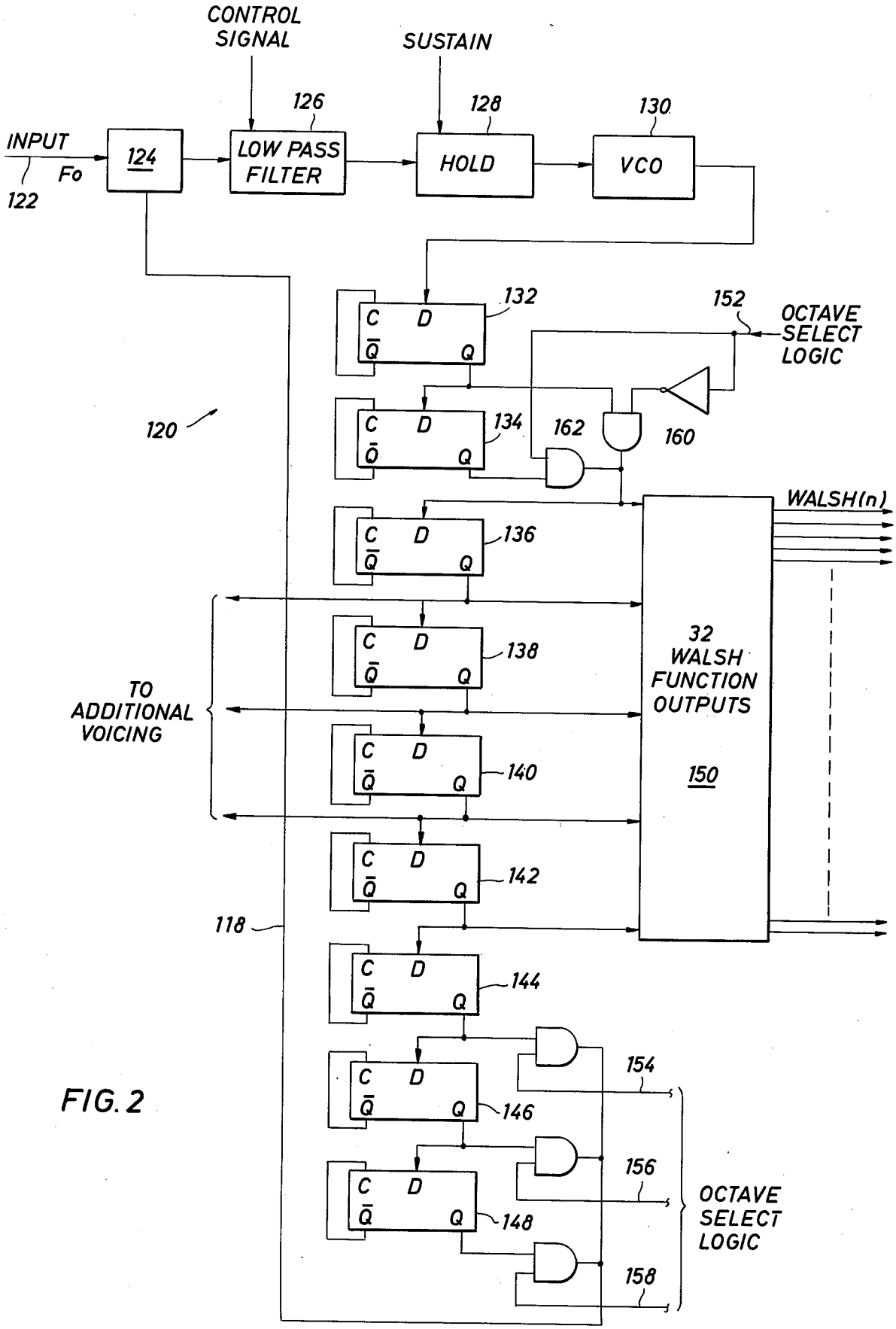
FIG. 2 is a detailed block diagram schematic of a phase lock loop circuit and part of the Walsh function generator matrix.

As will be observed, the description of FIG. 1 is rather general in scope. Going to FIG. 2, a special case can now be observed in a Walsh function generator 120. It is a special case because it includes components which are optional, not mandatory. The optional components will be identified. The significant point is that the apparatus receives a squarewave input conductor 122. The numeral 124 identifies a summing gate which sums the input on the conductor 122 and the feedback signal on the conductor 118. The conductor 118 corresponds in purpose and function to the conductor 18 shown in FIG. 1. Accordingly, the summing gate 124 forms a summed output signal (an error signal) which is applied to a low pass electronically programmed filter, at 126. It is electrically programmed by an input signal on a conductor. The filter has its roll off point varied so that the low pass band has adjustable width. The control signal enhances the operational range of the device for musically desirable effects. The numeral 128 identifies a sustain or hold circuit. At this juncture, it will be appreciated that this circuit is working on an analog signal which is an error signal. In other words, the circuit 128 stretches or holds the error signal to it. It thus serves as an input for a voltage control oscillator 130.

The oscillator 130 forms an output signal which is supplied to a flip-flop 132. The flip-flop 132 counts down or divides the input frequency by two to form the output signal. The flip-flop 132 drives the flip-flop 134. It also counts down by two. The flip-flop 134 functions like the flip-flop 132, and, indeed, the other flip-flops function in the same manner. Briefly, they all have two inputs and form two outputs. The outputs are the inverse of one another and are represented by conventional symbols in the drawings.

The flip-flop 134 forms an output at one-fourth the frequency of the input to the flip-flop 132, and this connects through a cascade of additional flip-flops at 136, 138, 140, 142, 144, 146 and 148. It will be observed that the preferred embodiment utilizes five intermediate taps in the cascade of flip-flops. These taps are input to a Walsh generator matrix 150. A typical Walsh function generator will be discussed and described with respect to FIG. 3 of the drawings.

For the moment, the Walsh function generator details will be ignored, and the remainder of the loop will be described. Countdown is achieved at each level. The countdown is achieved wherein a division by two occurs at each level. The several levels of serially connected flip-flops thus form a lower frequency at each stage. This configuration is rigid except that several control inputs are provided. The numeral 152 identifies one input conductor, while the conductors 154, 156 and 158 are also input through various gates to change the total division factor of the chain of flip-flops. It will be observed that these four inputs are connected to suitable intermediate gates for the purpose of modifying the multiplication of the chain. It will be observed further that the conductor 152 provides enable signals for a pair of AND gates 160 and 162. When one is enabled, the other is not enabled so that the chain is not broken. Moreover, it is desirable that one of the three signals on the conductors 154, 156 and 158 form an enable pulse because they are collectively summed by connection to the conductor 118.

The conductor 118 is thus provided with a signal which is primarily a squarewave and which has a frequency which is related to the input to the loop. If there are seven stages, conventional operation of the flip-flops dictates that the cascade provide a frequency change of 128-fold. Various stages can be omitted so that 32, 64, 128 or 256 is the multiplier or factor. The number of flip-flops is a matter of scale and can be varied.

Attention is next directed to FIG. 3 of the drawings. There, the inputs for the Walsh function generator 150 have been simplified by showing on a chain of several flip-flops. Thus, the flip-flop 134 is cascaded to the flip-flop 136, omitting all intermediate connections. The flip-flop 136 is shown directly connected to the flip-flop 138. This is repeated across the drawing. It will be observed that all the flip-flops form outputs which are summed at exclusive OR gates. They then form the thirty-one output signals. More importantly, these are all binary signals having the virtues of binary signals.

FIG. 3 shows the arrangement of several of the different Walsh levels. It will be observed that, in each instance, they have digital inputs and form digital outputs. Thus, the output of the entire circuit is simply binary levels. The binary levels are then input to the commutator 21, better shown in FIG. 1 of the drawings.

Perhaps more ought to be noted concerning the control word storage register 25. A single word can be used. Alternately, a sequence of words can be fed in through the register 25 to the buffer 26. A method of generating control words can be simply the setting of several inputs. To this end, the buffer 26 receives and stores a single word indefinitely. The word may be single or multiple bits, and the output from the buffer 26 is the several conductors 152, 154, 156 and 158 shown in FIG. 2. Briefly, these inputs serve as an octave select signal and will further include the inputs to the low pass electronically programmed filter 126 and the hold circuit 128. The control word thus modifies the operation of the Walsh function generators.

The control word is one source of changes in the operation of the voicing. Assume, for purposes of illustration, that a fixed control word is input. Assume further that the summing circuit 24 is set to provide a fairly close simulation of the musical instrument which is forming the input. In this instance, the present invention will form a kind of chorus instrument backing the original instrument. It will be operated to form an output signal approximately in synchronization with the input signal. Moreover, it will be in synchronization on such nuances as the attack of each note, the transition between notes, the changes in volume and the like.

Tracing through one operation of the equipment, assume that the fundamental frequency is 440 cycles. This note corresponds to the middle A, and assume further that the note is monotonic in nature. If this is the fact, the N Walsh function generator forms harmonics up to a level of N/2 times 440. The phase lock loop circuit tracks very close to the input tone.

The present invention is not a sine wave additive system in the sense that multiple sine waves can be added to synthesize a complex waveform. Those devices might be generally termed Fourier wave generators, which are distinctly different from the present invention. This device functions in a contrary manner, namely, the generation of the various harmonics as digital waveforms. These waveforms are digital, meaning that they have only two values, the two values sometimes being denoted as "off" and "on," "false" and "true," "zero" and "one," etc.

The control word storage register 25 in a source of signals which vary the input and performance. Again, if a single word is stored there, the system is fixed in its operation as long as that particular word is used.

Returning now to FIG. 1 of the drawings, it will be observed that the signal for generation of the Walsh harmonics has been described in some detail. However, FIG. 1 incorporates other equipment of note. The signal from the transducer 12 is applied to a trigger detector circuit 30. There is also an envelope detector circuit 31. These two circuits respond to the signal supplied from the transducer to determine the onset of a given musical note and, hence, form a trigger output signal on a conduit 32. In like manner, the musical note will resemble an amplitude modulated signal, and, therefore, the envelope is detected, and an output is formed corresponding to the envelope shape on the conduit 33. These two analog detectors form signals used in other portions of the equipment, as will be described.

The numeral 36 identifies an external analog parameter set point. Briefly, this is a set of voicing potentiometers which provide adjustments or level controls. They can be few or numerous as desired. The numeral 37 identifies an oscillator which forms a repetitive shaped waveform at a specified frequency. It is connected to an external envelope generator 38. The generator 38, when provided with the signal from the signal generator 37, forms an output signal which describes an arbitrary envelope shape. The envelope shape of a typical note typically begins with a rather sharp rise time at the front of the note and tapers to silence unless otherwise earlier terminated. The operation of the peddle on a piano is one typical device which sharply terminates a sustained note. Without regard to the source of the note profile or envelope, the apparatus described here forms an alternate envelope shape. It can taper from small to large, large to small and so on, all dependent on the shape or profile desired. To this end, it is wise to use an adjustable shape signal generator. It restarts on each note.

The numeral 39 identifies a special effects input. Excessive vibrato, white noise and other special effects can be used. An easy example of the use of white noise in a specified band width is to simulate the effect of a brush applied to a cymbal. All these signals are input to a command multiplexer 40. The multiplexer 40 sequentially selects various set points or control functions which are input from the sources just described and multiplexes these output signals for delivery to a command demultiplexer 42. The demultiplexer 42 then provides command signals to the ensemble processor 24.

The ensemble processor is a type of summing circuit. A relatively neat and simplistic summing circuit is simply a set of commonly connected series resistors, one for each harmonic. This can be used as an example, but the preferred embodiment of the present invention utilizes an ensemble processor 24 of substantially greater complexity and versatility. Consider for the moment the exemplary structure shown in FIG. 4.

FIG. 4 shows the input of four Walsh functions. In FIG. 4, the numeral 240 identifies a first amplifier which is, ideally, at least an emitter follower current amplifier for isolation of the input Walsh function. A similar amplifier is shown at 242. The two of them connect to a summing node through a series coupling resistor 244 and an additional resistor 246. All of these signals are summed, and then the output of the sum is amplified by an amplifier 248. The amplifier, itself, is connected to the input of an analog delay line 250 providing a signal delay of a specified duration. The delay line 250 is typically an analog device interposing a selected amount of delay.

The numeral 262 identifies a binary rate multiplier which has as its input one of the Walsh function signals. A binary rate multiplier is a device which, when furnished with a digital signal occurring at a certain repetition rate, multiplies the repetition rate of the output. For sake of variety, this Walsh function is multiplied by some factor, and then it is output to a switch 264. At the switch 264, it is delivered to one of two terminals, the two terminals being additive or subtractive. The two terminals are connected to opposite sides of the amplifier 248 whereby the multiplied input signal is either added or subtracted depending on the switch position.

The ensemble processor 24 shown in FIG. 4 thus puts together several Walsh functions to construct what is eventually an audio signal. The ensemble processor thus utilizes a number of summing circuits.

It will be observed that FIG. 4 incorporates enable gates having the form of AND gates 266 and 268. These are provided with enable signals from the command demultiplexer 42. They can be switched into or out of the circuit depending on the enable signals which are provided. Moreover, through the use of M ensemble processors 24, each can be provided with suitable control signals to group and alter the several Walsh signals for suitable voicing by each ensemble processor. In other words, several identical processors can be used, and each one is triggered by enable signals from the command demultiplexer. Needless to say, enable gates can be placed on each of the Walsh function inputs to the ensemble processor 24 shown in FIG. 4.

Returning now to FIG. 1 of the drawings, the numeral 43 identifies a clock which is input to an address counter 44. The counter 44 is reset to its initial condition by the address counter reset circuit 45. It is, in turn, triggered by the trigger detector signal on the conductor 32. The trigger is the beginning point of a note which is supplied over the conductor 32 to the reset generator 45 which, in turn, restores the address counter 44. The numeral 46 identifies a memory source selector which provides signals to the command multiplexer to control its timed operation. The memory source selector can implement any sequence of command multiplexer operations as desired. In addition, a memory control channel selector 48 is identified in FIG. 1, and it is operated by the address counter 44. It causes the device to call up certain stored sequences depending on the programming desired. These are input to the command demultiplexer 42.

The multiplexer 40 and the demultiplexer 42 work together, as will be appreciated. Signals for voicing are delivered in timed sequence, and they are used in timed sequence. These sequences are controlled by the memory circuits 46 and 48. Moreover, the multiplexing system including the command multiplexer teamed with the demultiplexer delivers the voicing signals appropriate for the ensemble processor. Consider any easy example. Suppose it is necessary to voice one string on a guitar to a lower voice. Suppose the change in frequency is by one octave, or a reduction on the fundamental frequency by two. It will be appreciated that the N Walsh functions made available to a particular ensemble processor 24 will include the fundamental frequency. By the application of suitable enable pulses to the enable gates in the chain of flip-flops, the frequency of the chain can be altered. It can be altered by increasing or decreasing the frequency easily by steps of two. Such a change is easily implemented at the Walsh function generator. These signals are then collectively formed and passed through the commutator 21 to the ensemble processor 24. The ensemble processor inputs a selected set of Walsh signals which are summed in some suitable fashion with suitable weighting factors, and a musical note is created. As an example, the note that is created can be voiced to one octave lower than the original note, and, yet, it will still have the characteristics of the original note that are of great interest. These characteristics include, as for example, the initiation of the note at the same instant as detected by the trigger detector 30. Special effects and external envelope modification can be achieved by overriding through the use of signals delivered to the command multiplexer 40 and then conveyed to the demultiplexer 42. These are implemented by opening and closing the enable gates shown in FIG. 4.

Attention is next directed to FIG. 5 of the drawings which shows an ensemble processor 324. It is an enlarged, more complex version of the structure disclosed at 24 in FIG. 1, or the exemplary apparatus in FIG. 4. Moreover, the apparatus 324 in FIG. 5 is more complex but yields greater versatility.

The apparatus shown in FIG. 5 is supplied in quantities of one or more. With multiple ensemble processors, a greater variety of simultaneous music synthesis can be accomplished.

FIG. 6 discloses an optional apparatus to be incorporated with the present invention. It enables a musician, as, for example, a person using a guitar, to form signals which instruct the apparatus. The present invention has been discussed as though it were a monotonic apparatus, that is to say, an apparatus which handles a single note at a time. Sometimes, chords are struck simultaneously on guitars and the like. When a chord is formed, the present invention contemplates the use of a music synthesizer of the sort generally shown in FIG. 1 for each string. By this means, multiple notes can be processed simultaneously. In FIG. 6, an apparatus is illustrated which recognizes selected chords. The input to the circuitry of FIG. 6 is from the music instrument, itself, namely, from the transducer. In other words, the raw, substantially unprocessed signal is supplied. Assume that the apparatus of FIG. 6 is set up so that the apparatus recognizes an unusual chord formed of three notes. Accordingly, the circuitry of FIG. 6 never responds as long as the chords formed by the musician are something other than the unusual combination. However, when the unusual chord is struck by the musician, the chord is recognized. It is recognized by tuned filters 400, 402 and 404. All of these filters form enable pulses for an enable gate 406. It, in turn, advances a register 408. The register is advanced to the next count. After the register has been cued, it changes the count stored in the register 408. The register, itself, can be used to control the command multiplexer to instruct it to obtain a different set of presets to be supplied to the ensemble processor 24. This will, of course, change the voicing. The musician can use a combination of notes which therefore does not occur in his music to signal the equipment through the accessory equipment shown in FIG. 6 to initiate operation in a different mode.

It is helpful to note that the present invention has certain virtues. Through the use of the Walsh tracking resonant synthesizer, certain virtues are obtained, as, for example:

(a) Tracking of the input signal fundamental frequency and simultaneous parallel generation of all possible audible harmonics of the particular input frequency through the use of the phase lock loop circuitry to form Walsh function output signal(s) yields high accuracy and instantaneous availability of the Walsh function signals, the basic building block for synthesis.

(b) Tracking of the input signal amplitude envelope, note initialization, harmonic content and music control variations in the note and conversion of these variables into analog control signals preserves the music quality unique to the musician and his instrument.

(c) A memory stored program accessed by multiplexing and switching through digital control apparatus achieves real time digital control of the ensemble processor 24. In particular, this is accomplished by or under the control of the operator selected presets.

(d) The timing of operation is operator controlled; yet, after initial conditions are set up and the presets are arranged, the apparatus functions indefinitely to form synthesized music including delayed waveforms or simultaneously occurring waveforms, all with tracking or subject to various special effects, utilizing the sequence of input musical notes as a reference.

The present apparatus is described by the disclosure directed to the preferred embodiment, but the scope thereof is determined by the claims which follow.

I claim:

1. A synthesizer for forming music which is dependent on musical notes obtained from a source which comprises:

(a) input terminal means for receiving a signal which is representative of a sequence of musical notes having distinctive musical characteristics;

(b) a Walsh function generator means forming N Walsh functions where N is a whole number integer and which generator means is connected to said output terminal for forming N output signals which are Walsh functions of the input;

(c) wherein said Walsh function generator means comprises:

(1) a voltage control oscillator; and (2) a loop connected to said voltage control oscillator and extending from the output thereof back to the input thereof which loop forms an error signal comparing the phase of the input to said loop with the input from said input terminal; and (d) means connected to said output signals from said function generator means for mixing specified function signals in specified proportions to form a signal representative of a musical note related to the signal supplied to said input terminal.

2. The apparatus of claim 1 wherein said mixing means utilizes at least three of the Walsh function signals and wherein they are mixed in selected relative portions and are additionally filtered to remove selected high frequency constituents therein.

3. The apparatus of claim 1 wherein said loop is a phase lock loop for operation of said voltage control oscillator and further including in said loop a cascade of divider circuits which form digital outputs having a frequency reduced by two at each stage.

4. For use in a music synthesizer, a circuit which forms N output signals where N is a whole number integer and the output signals are suitable for mixing to form synthesized music, the apparatus comprising:

(a) a phase lock loop circuit means having an input comparator receiving an input reference signal;

(b) a voltage control oscillator having an input terminal connected to said comparator;

(c) M stages of binary dividers connected in cascade and provided with the output signal from said voltage control oscillator;

(d) a feedback loop connected from said M cascaded dividers to said comparator wherein said comparator means is constructed and arranged to form a comparison of the phase of the signals provided thereto and to form a control signal for said voltage control oscillator; and (e) a plurality of exclusive OR gates connected to said digital dividers for forming N Walsh function output signals.

5. The apparatus of claim 4 wherein said dividers include one additional divider for adjustably changing the aggregate dividing rate of the cascaded dividers by a factor of two.

6. The apparatus of claim 4 wherein said voltage control oscillator is input from to a low pass filter serially arranged in said loop.

7. For use in a music synthesizer to form synthesized music and which synthesizer is at least in part dependent on a source of monotonic music notes input thereto, an apparatus which comprises:

(a) an input terminal for receiving a sequence of musical notes;

(b) a low pass filter connected to said input terminal for attenuating relatively the harmonics above the fundamentals of the input music notes received at said input terminal;

(c) a music note trigger detector connected to said low pass filter for forming an output signal which occurs on the initiation of each input signal representative of a musical note;

(d) means for generating N Walsh function signals where N is a whole number integer and which signals are generated in frequency relationship to the fundamental frequency of the input notes in sequence;

(e) wherein said Walsh function generator means comprises:

(1) a voltage control oscillator; and (2) a loop connected to said voltage control oscillator and extending from the output thereof back to the input thereof which loop forms an error signal comparing the phase of the inpt to said loop with the input from said input terminal; and (f) mixer means for said N Walsh function signals for mixing them in a selected portion and which mixer means is intiated in operation by the signal from said trigger detector means.

8. The apparatus of claim 7 including means in said trigger detector means for sensing occurrence of musical note initiation by comparison with a specified amplitude standard.

9. The apparatus of claim 7 including envelope detector means which is supplied with the signals representative of the input musical notes which detects and forms an envelope signal derived from the input notes and wherein said envelope detector means controls said mixer means to shape the envelope of the mixed Walsh function signals to thereby define an envelope for said mixed signals.

10. The apparatus of claim 7 wherein said trigger detector means includes a Schmitt trigger circuit means.

11. A music synthesizer for forming synthesized music which is at least in part shaped and otherwise dependent on the shape, frequency, timbre and pitch of a sequence of input musical notes monotonically arranged, the apparatus comprising:

(a) a fundamental frequency tracking squarewave generator which forms an output squarewave which tracks the fundamental of monotonic notes furnished thereto;

(b) a Walsh function generator means connected to said squarewave generator for forming a plurality of Walsh function signals output therefrom which are related to the fundamental frequency input to said squarewave generator;

(c) commutator means connected to said Walsh function generator means for selecting at least three Walsh function signals therefrom; and (d) mixing means connected to said commutator means for mixing the selected Walsh function signals to synthesize an output signal representative of a synthesized musical note.

12. The apparatus of claim 11 further including a delay line means for performing time-delay or time-delay dependent analog operations upon the ensemble processor synthetic waveforms in order to permit desirable overtone characteristics to be enhanced.

13. An apparatus for forming synthesized music which is at least in part dependent on input signals provided thereto which represent monotonically occurring notes which notes have a fundamental and harmonics and which notes further have musical qualities including timbre, pitch, harmonic mix and wherein the apparatus comprises:

(a) a low pass filter for receiving signals representative of a series of monophonically occurring musical notes;

(b) means connected to said low pass filter for receiving the signal passed thereby and which means forms an output signal indicating the occurrence of the start of the monophonically occurring notes, said signal serving as a trigger signal;

(c) multiplexer means having M inputs thereto and N outputs therefrom, where M is larger than N and M and N are both whole number integers, and the inputs thereto are a set of presets; and (d) a controllable mixer means for forming synthesized music having the form of a series of output signals representing monotonically occurring synthesized notes wherein said mixer means is controllable in the mixing achieved thereby and incorporates control means which are operated by N preset signals provided thereto from said multiplexer means and said mixing achieved by said mixer means is intitiated by the trigger signal input thereto and said mixer receives said multiplexer output signals as inputs thereto.

14. The apparatus of claim 13 wherein said multiplexer means has a plurality of input presets scaled in arbitrary units.

15. The apparatus of claim 13 including a demultiplexer connected between said multiplexer means and said controllable mixer for controllably selecting specified presets for application to said controllable mixer means.

16. The apparatus of claim 11 including a delay circuit means connected to said mixing means, and further including means for adjusting the operation thereof to obtain an echo of adjustable delay in comparison with the undelayed, mixed signal to variably simulate a reverberant enclosure.

17. The apparatus of claim 16 including means for variably modulating the delay of said delay circuit means to obtain a musical vibrato effect.

18. The apparatus of claim 11 including storage means for receiving and storing control signals to obtain time modulated voicing of mixing means.

19. The apparatus of claim 18 including means connected to said storage means which selectively and controllably alters the mix of Walsh signals mixed by said mixing means.

20. The apparatus of claim 11 including note recognition means supplied with input musical notes in signal form which means recognizes and responds to predetermined note patterns to form a signal indicative of the occurrence thereof, and the signal so formed is supplied to means altering operation of said mixing means.

21. The apparatus of claim 19 including at least two storage means for receiving and storing different signals for altering the mix of Walsh signals such that each stored signal is called from said storage means at predetermined intervals to initiate operation of selected presettable controls incorporated in said mixing means.

* * * * *